US005125378A

United States Patent [19]

Westerbeke, Jr.

[11] Patent Number: 5,125,378

[45] Date of Patent: Jun. 30, 1992

[54] COOLING SYSTEM FOR AN ENCLOSED HEAT SOURCE

[75] Inventor: John H. Westerbeke, Jr., Milton, Mass.

[73] Assignee: Westerbeke Corporation, Avon, Mass.

[21] Appl. No.: 699,174

[22] Filed: May 13, 1991

Related U.S. Application Data

[63] Continuation-in-part of Ser. No. 605,529, Oct. 29, 1990, Pat. No. 5,014,660.

[51] Int. Cl.[5] ..... F02B 77/00

[52] U.S. Cl. ..... 123/198 E; 123/2; 123/41.01; 181/202; 181/204; 440/113

[58] Field of Search ..... 123/2, 41.31, 41.57, 123/41.01, 198 E; 165/51; 290/1 R, 1 A, 1 B; 114/269, 270; 181/202, 204; 440/3, 6, 84, 88, 113, 900

[56] References Cited

U.S. PATENT DOCUMENTS

| | | | |
|---|---|---|---|
| 3,144,858 | 8/1964 | Horning et al. | 123/41.31 |
| 4,734,070 | 3/1988 | Mondek | 440/88 |
| 4,747,360 | 5/1988 | Tuncel et al. | 114/269 |
| 4,836,123 | 6/1989 | Grinde et al. | 114/270 |
| 4,924,826 | 5/1990 | Vinson | 123/198 E |

FOREIGN PATENT DOCUMENTS 3402772 8/1985 Fed. Rep. of Germany ... 123/198 E

OTHER PUBLICATIONS

Westerbeke, *SoundGuard* literature, Feb. 1990.

*Primary Examiner*—Noah P. Kamen

[57] ABSTRACT

A cooling system is provided for enclosed first and second heat sources including an enclosure substantially enclosing the heat sources. The first and second heat sources are positioned in the enclosure. A heat exchanger, also positioned within the enclosure, is connected through the enclosure to an external source of cooling fluid and is adapted for cooling air within the enclosure. The heat exchanger has a first surface for receiving the air to be cooled and a second surface for expelling cooled air. First and second air circulation means are provided within the enclosure for circulating air past both the first and second heat sources and the heat exchanger. A first baffle portion separates the first and second heat sources and extends to the first surface of the heat exchanger, and a second baffle portion extends to the second surface of the heat exchanger. The first and second baffle portions extend to positions that are spaced along the heat exchanger, and, thus, air flow from one of the air circulation means supplements air flow from the other of the air circulation means. A method of cooling an air cooled heat source within an enclosure is also provided.

8 Claims, 1 Drawing Sheet

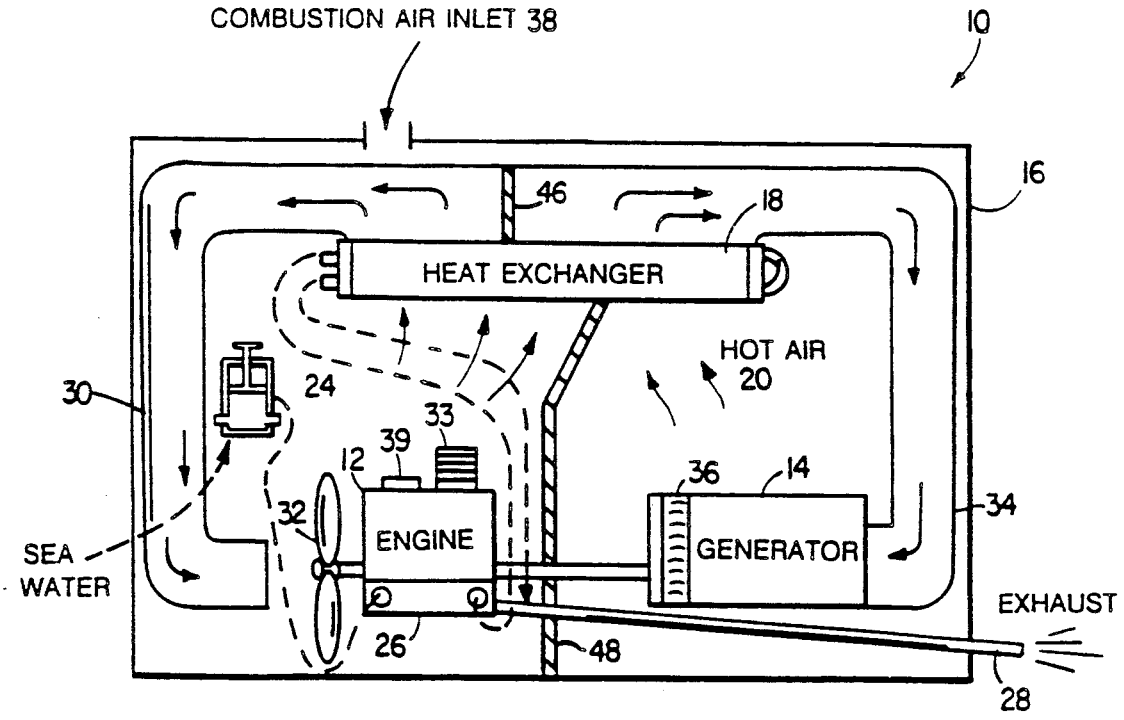
COMBUSTION AIR INLET 38
10
16
46
18
HEAT EXCHANGER
HOT AIR
20
30
24
33
39
12
36
14
34
32
ENGINE
GENERATOR
SEA
WATER
EXHAUST
26
48
28

COOLING SYSTEM FOR AN ENCLOSED HEAT SOURCE

BACKGROUND OF THE INVENTION

This application is a continuation-in-part of U.S. Application Ser. No. 07/605,529, filed Oct. 29, 1990, now U.S. Pat. No. 5,014,66.

The invention relates to cooling enclosed power generating heat sources, and more particularly to cooling engine driven generators (gensets), especially those utilized in marine vehicles.

Engine driven generator sets include an electrical generator powered by an auxiliary engine. Because of the inefficiencies of the processes, the machinery loses a significant portion of its output energy in the form of heat generation. This heat must be dissipated so that it does not result in a loss of efficiency or even danger to those present. Therefore, various forms of heat dissipation systems are utilized.

One common system of heat dissipation for heat producing machinery is to expose the machinery to the ambient air and utilize fans to both draw air into and to expel air from the machinery. Because ambient air is normally considerably cooler than the heat generating machinery it is cooling, the system results in satisfactory cooling. An alternate embodiment of this system is to employ a liquid cooled engine in which the engine includes a jacket through which water or other coolant is circulated to dissipate heat. The generator is air cooled as before. Significant noise is created by the machinery, and heat is dissipated by the machinery, even to a certain extent when jacketed and liquid cooled, and the noise and heat are output to the ambient surroundings. The noise and the dissipated heat restrict the possible locations for the system. Thus, it is normally objectionable to place the machinery near passengers in a vehicle.

The heat producing machinery can be placed within the passenger compartment, however, if it is contained within an enclosure. The enclosure is provided with a heat exchanger, utilized within the enclosure, and with a means for circulating air past both the heat exchanger and the heat source. Such a system configuration (described in U.S. Application Ser. No. 07/605,529) serves to dissipate the heat generated by the machinery and to reduce noise levels emanating from components of the system to the environment.

SUMMARY OF THE INVENTION

In one aspect, the invention features a cooling system for substantially enclosed power generating first and second heat sources. The heat sources are positioned within an enclosure. A heat exchanger, also positioned within the enclosure, is connected through the enclosure to an external source of cooling fluid and is adapted for cooling air within the enclosure. The heat exchanger has a first surface for receiving the air to be cooled and a second surface for expelling cooled air. First and second air circulation means are provided within the enclosure for circulating air past both the first and second heat sources and the heat exchanger. A first baffle portion separates the first and second heat sources and extends to the first surface of the heat exchanger, and a second baffle portion extends to the second surface of the heat exchanger. The first and second baffle portions extend to positions spaced along the heat exchanger, and, thus, air flow from one of the air circulation means supplements air flow from the other of the air circulation means.

Preferred embodiments of this aspect of the invention include the following features. Duct work positioned within the enclosure is connected to the second surface of the heat exchanger, and cooled air expelled from the heat exchanger is circulated via the duct work past the first and second heat sources. The second baffle portion is positioned within the duct work. and the first baffle portion extends from inside the surface of the enclosure. The first and second air circulation means comprise air circulation fans, and the cooling fluid circulating means comprises a pump. The first and second heat sources can include an air-cooled generator, a combination air-cooled engine-generator arrangement, or a combination water-cooled engine air-cooled generator arrangement. The enclosure includes an aperture to admit external combustion air into the enclosure to the engine's air intake. The air intake can be spaced from the aperture, in which case the aperture is minimally sized for the admission of combustion air. When the cooling system is in a watercraft, the external source of cooling fluid is water external to the watercraft.

In another aspect, the invention features a method of cooling first and second power generating heat sources in an enclosure. This method provides within the enclosure a heat exchanger adapted for cooling air therewithin and first and second air circulation means associated with the first and second heat sources. Cooling fluid obtained external to the enclosure is circulated through the heat exchanger, and air within the enclosure is circulated past both the heat exchanger and the first and second heat sources so that air flow from one of the air circulation means supplements air flow from the other of the air circulation means.

Thus, the invention provides a cooling system which can effectively cool heat generating machinery by utilizing an air-cooling process, or partial air-cooling process, in a substantially air tight enclosed space, and can thereby remove the dissipated heat within the enclosure while reducing a significant portion of the noise resulting from the operation of the machinery. The system can function effectively even when specific air circulation fans associated with the machinery have different flow pressure drop characteristics. It is thus possible to place an enclosed genset in convenient locations which would otherwise be objectionable, e.g., in proximity to passengers in a vehicle.

These and other objects, features and advantages of the invention will be seen from the following description of preferred embodiments, and from the accompanying drawings and claims.

BRIEF DESCRIPTION OF THE FIGURE

The FIGURE is a diagrammatic illustration of one embodiment of the invention.

DETAILED DESCRIPTION OF PREFERRED EMBODIMENTS

Generally, the system includes heat producing machinery contained within an enclosure. The enclosure serves to contain the heat dissipated by the machinery and to reduce noise levels emanating from components of the system to the environment. Therefore, the heat producing machinery can be placed anywhere on the vehicle without discomfort or danger to the passengers. However, because the excess heat contained within the enclosure can damage the machinery and could even result in dangerous situations, a heat exchanger is utilized within the enclosure to dissipate the heat.

Referring now to FIG. 1, an engine driven generator set 10 is depicted which can be utilized in a boat. Both the engine 12 and the generator 14 in this embodiment are contained within a substantially airtight enclosure 16. This enclosure can be partially or fully lined with a sound absorbing material such as an open cell urethane foam, e.g., a laminate sold under the name Soundmat PB "M" by The Soundcoat Company, Inc., of Deer Park, N.Y., comprising two layers of foam laminated to an intermediate flexible vinyl layer and faced on the exposed side with a protective acrylic film. In this way, the genset can be placed in various locations about the boat, including areas containing passengers, without adding substantial heat and noise to the surroundings and hence, creating an uncomfortable environment. The generator 14 is air cooled. The engine 12 may be air cooled or may be water cooled, utilizing a standard water cooled engine of the art, leaving only the generator to be air cooled. In this latter case, surface heat emanating from the engine is dissipated by the air cooling method described below.

A heat exchanger 18 is utilized to dissipate heat within the enclosure and includes a fluid side and an air side. Hot air 20 enters the heat exchanger and is cooled by a cool circulating fluid contained within the heat exchanger 18. The cool fluid is pumped into the heat exchanger from an outside source. When the genset is utilized in a marine vehicle, the external source may be the raw sea water surrounding the marine vehicle. Otherwise, recirculating water or other coolant is utilized as the source. When the hot air 20 contacts the cool fluid in the heat exchanger, thermal transfer occurs. Thus the air exits the heat exchanger as cooled air while the fluid exits the heat exchanger as warmed fluid.

In the illustrated embodiment, the heat exchanger 18 is arranged in series with both the engine and the generator, but cooling of these machines is accomplished in parallel. The fluid side of the cycle begins with an external fluid source. In the embodiment illustrated in FIG. 1, raw sea water is pumped via pump 24 into the enclosure and then into the fluid side of the heat exchanger. The aperture through which the conduit for the water passes is sealed about the conduit in an air tight manner. The water may pass through an oil cooler 26 utilized to lower the temperature of the oil contained in the engine. The water pump 24 is located within the enclosure 16 and is belt driven (not shown) from the engine. The raw water cools the hot air produced by the machinery. The warmed water is then pumped into the engine exhaust line 28 to lower the temperature of the outgoing exhaust and is discharged with the exhaust into the sea. Exhaust line 28 passes through enclosure 18 being sealed thereto in an air tight manner as is usual with marine exhausts passing through a hull. Alternatively, the raw sea water may be expelled separately from the exhaust.

The air side of the cycle is maintained as a closed circulating system. It begins with hot air produced by the machinery. This hot air 20 is directed into the heat exchanger 18, which cools the air. The air path then is separated into two parallel paths by baffle 46. The first path passes through air duct 30 to cooling fan 32 to the engine. The fan 32 moves cooled air from heat exchanger 18 through duct 30 past the engine 12. In the case of an air cooled engine cooling fins 33 are provided past which the cooled air is moved. Engine heat is thus transferred to the cool air. The cycle is repeated as the hot air is directed back to the heat exchanger.

Similarly, the second air path is directed through air duct 34 to the generator 14. The cool air is pulled through the generator by integral centrifugal cooling fan 36 and acts to transfer the heat from the generator to the air. The hot air exits the generator and is again directed toward the heat exchanger.

A baffle 48 positioned between engine 12 and generator 14 is oriented so as separate the hot air returned from the engine from that returned from the generator and to direct the returning hot air to separate portions of the heat exchanger surface. Baffle 48 extends from the walls of the enclosure, between the engine and generator, to the heat exchanger. A baffle 46 divides the cool air exiting the heat exchanger into separate portions, directed respectively into air duct 30 and air duct 34. By spacing baffle 46 toward the engine side of the enclosure relative to and away from baffle 48, air flow from the more powerful engine cooling fan 32 augments the air flow provided by generator integral centrifugal cooling fan 36. The placement of baffles 46 and 48 can be fine adjusted to compensate for the different flow pressure drop characteristics of the air circuits from the specific engine and generator used.

The engine is powered by fuel combustion and therefore requires air for the process. In one embodiment, combustion air is obtained from the circulating air within the enclosure 18. A portion of the air in the enclosure is utilized during the combustion process and must be replenished. Toward this end, a minimally sized combustion air inlet 38 remote from the engine air intake is included in the enclosure, comprising a small aperture formed in the wall of the enclosure. Of course, the sizing of the aperture varies for different engines, but an example of appropriate sizing for a 300 cc engine would be approximately 2 cm. by 2 cm. Ambient air from outside of the enclosure enters the system through this aperture. The entering combustion air is cooled by mixing with the cooled air present in the enclosure. Flame arrestor material (not shown) may be placed across inlet aperture 38 both for safety and to dampen noise. Alternatively, a carburetor inlet 39 may contain flame arresting material. This method of air intake aids in preventing noise generated by the carburetor intake pipe from emanating to the outside of the enclosure. Except for air inlet 38, enclosure 18 is preferably substantially air tight to contain noise and heat.

Thus, in accordance with the preferred embodiment of the invention the engine is contained in a substantially air tight enclosed space. There is, however, no need to derate the power output from the generator merely because it is contained within a sound enclosure whose internal air temperature would usually be higher than specified for the rated generator output. Rather, the internal air temperature is controlled under a predetermined maximum temperature dependant upon the raw water temperature. This invention allows for broad control of the generator inlet air temperature by sizing of the heat exchanger and fluid flow.

While the preferred embodiment is described for illustrative purposes, one skilled in the art should recognize many modifications in structure, arrangement, portions, and components used in the practice of the invention and otherwise which are consistent with the principles of the broader appended claims of the invention.

What is claimed is:

1. A cooling system for enclosed power generating heat sources, comprising:

first and second said heat sources;

an enclosure substantially enclosing said heat sources;

a heat exchanger positioned within said enclosure, said heat exchanger communicating through said enclosure for connection to an external source of cooling fluid and adapted for cooling air within said enclosure, said heat exchanger having a first surface receiving air to be cooled and a second surface from which cooled air is expelled;

first and second air circulation means within said enclosure associated respectively with said first and second heat sources and adapted for circulating air from said heat exchanger past said heat sources and said heat exchanger;

a first baffle portion on one side of said heat exchanger separating said first and second heat sources and extending to said first surface of said heat exchanger; and a second baffle portion on the other side of said heat exchanger extending to said second surface of said heat exchanger and separating said cooled air into a first portion directed toward said first heat source and a second portion directed toward said second heat source, said first and second baffle portions extending to said heat exchanger at positions spaced along said heat exchanger, whereby air flow from one of said first and second air circulation means supplements air flow from the other of said first and second air circulation means.

2. The cooling system claimed in claim 1 in which said first baffle portion extends from an inside surface of said enclosure.

3. The cooling system claimed in claim 1 further including a duct positioned within said enclosure and connected to said second surface of said heat exchanger, said second baffle portion being positioned within said duct and said duct extending from said heat exchanger to adjacent said heat sources at opposite ends of said duct, whereby said cooled air expelled from said heat exchanger is circulated past said first and second heat sources.

4. The cooling system claimed in claim 1 in which said heat sources comprise an engine and an air cooled generator.

5. The cooling system claimed in claim 1 in which said air circulation means comprise air circulation fans.

6. The cooling system claimed in any one of claims 1-5, inclusive, in which one of said first and second air circulation means generates a larger air flow than the other of said first and second air circulation means.

7. In an enclosure having a heat exchanger for modifying air temperature within said enclosure, two air circulating means on one side of said heat exchanger for circulating air within said enclosure in a path from said air circulating means to said heat exchanger and back to said air circulating means, and structure on the other side of said heat exchanger defining a portion of said path, the improvement in which:

a first baffle extends from structure surrounding said air circulating means, between said air circulating means, to said one side of said heat exchanger, thereby separating said air circulating means on said heat exchanger one side, and a second baffle extending from said structure on said other side of said heat exchanger to said heat exchanger at a position spaced along said heat exchanger from the position of said first baffle, whereby a portion of the air flow from one of said air circulating means is adapted to supplement the air flow from the other of said air circulating means.

8. A method of cooling substantially enclosed power generating first and second heat sources in an enclosure, said method comprising:

providing first and second air circulation means within said enclosure associated with said first and second heat sources;

providing a heat exchanger within said enclosure adapted for cooling air therewithin;

connecting said heat exchanger to a source of cooling fluid external to said enclosure;

circulating said cooling fluid obtained external to said enclosure through said heat exchanger; and circulating air within said enclosure past said heat exchanger and said first and second heat sources and diverting a portion of the air flow from one of said air circulation means to supplement air flow from the other of said air circulation means.

* * * * *